US007665973B2

(12) United States Patent
Hwang

(10) Patent No.: US 7,665,973 B2
(45) Date of Patent: Feb. 23, 2010

(54) APPARATUS FOR CHANGING CAPACITY OF MULTI-STAGE ROTARY COMPRESSOR

(75) Inventor: Seon-Woong Hwang, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 734 days.

(21) Appl. No.: 11/140,906

(22) Filed: Jun. 1, 2005

(65) Prior Publication Data

US 2006/0090488 A1 May 4, 2006

(30) Foreign Application Priority Data

Nov. 1, 2004 (KR) ..... 10-2004-0088013
Jan. 18, 2005 (KR) ..... 10-2005-0004710

(51) Int. Cl.
*F04B 49/00* (2006.01)

(52) U.S. Cl. ..... 417/310; 417/288; 251/63.6

(58) Field of Classification Search ..... 417/213, 417/285–289, 310; 251/63, 63.5, 63.6; 257/70, 257/71, 73, 74, 166, 170, 174, 179; 239/583
See application file for complete search history.

(56) References Cited

U.S. PATENT DOCUMENTS 3,002,461 A * 10/1961 Eames, Jr. ..... 417/287
3,552,658 A * 1/1971 Sons ..... 239/456
3,727,877 A * 4/1973 Beguiristain ..... 251/30.05
3,779,537 A * 12/1973 Kalister ..... 267/166.1

(Continued)

FOREIGN PATENT DOCUMENTS

EP 1312880 5/2003

(Continued)

OTHER PUBLICATIONS

English language Abstract of JP 7-35071.

(Continued)

*Primary Examiner*—Devon C Kramer
*Assistant Examiner*—Dnyanesh Kasture
(74) *Attorney, Agent, or Firm*—KED & Associates, LLP

(57) ABSTRACT

An apparatus for changing capacity of a multi-stage compressor comprises: a first cylinder provided with a first suction and a first discharge port, and divided into a first suction chamber and a first compression chamber by a first rolling piston which orbits and a first vane which makes a linear movement in contact with the first rolling piston; a second cylinder provided with a second suction port and a second discharge port, and divided into a second suction chamber and a second compression chamber by a second rolling piston which orbits and a second vane which makes a linear movement in contact with the second rolling piston; a middle bearing inserted between the first cylinder and the second cylinder, having a bypass hole to allow communication between the compression chambers of the first cylinder and the second cylinder, and having a valve hole for communication in the middle of the bypass hole; a sliding valve slidingly coupled to the valve hole of the middle bearing, and selectively opening or closing the bypass hole; and a pressure switching unit for selectively supplying discharge pressure to one side of the sliding valve, thereby changing a capacity using all the plural compression units, and obtaining power saving effect suitable for the saving mode.

11 Claims, 7 Drawing Sheets

U.S. PATENT DOCUMENTS

| | | | | |
|---|---|---|---|---|
| 4,712,778 | A * | 12/1987 | Newman | 267/170 |
| 4,726,739 | A | 2/1988 | Saitou et al. | |
| 4,905,775 | A * | 3/1990 | Warren et al. | 175/38 |
| 5,152,156 | A * | 10/1992 | Tokairin | 62/498 |
| 5,190,076 | A * | 3/1993 | Kloehn | 137/625.5 |
| 5,775,882 | A * | 7/1998 | Kiyokawa et al. | 417/310 |
| 6,796,773 | B1 | 9/2004 | Choi et al. | |
| 2003/0106330 | A1 | 6/2003 | Yamasaki et al. | |
| 2005/0247354 | A1 * | 11/2005 | Hezel et al. | 137/625.65 |

FOREIGN PATENT DOCUMENTS

| | | |
|---|---|---|
| JP | 7-35071 | 2/1995 |
| JP | 7-54782 | 2/1995 |

OTHER PUBLICATIONS

English language Abstract of JP 7-54782.
U.S. Appl. No. 11/111,850 to Hwang et al., which was filed on Apr. 22, 2005.

* cited by examiner

APPARATUS FOR CHANGING CAPACITY OF MULTI-STAGE ROTARY COMPRESSOR

BACKGROUND OF THE INVENTION

1. Field of the Invention

The present invention relates to a rotary compressor performing multi-stage compression, and more particularly, to a multi-stage rotary compressor capable of optimizing compression efficiency using all compression units.

2. Description of the Background Art

A compressor is a device that increases pressure by compressing the air, a refrigerant gas or other specific gases upon receiving power from a power generator such as an electric motor, and is being used throughout industries. The compressor may be divided into a positive displacement compressor and a turbo compressor according to how to compress. The positive displacement compressor performs compression by a compression method in which pressure is increased through a volume decreased, and the turbo compressor performs compression by converting kinetic energy of gas into pressure energy.

A rotary compressor, which is a kind of positive displacement compressor, is commonly used for an air conditioning apparatus such as an air-conditioner. In response to demands for air-conditioners having various functions, the rotary compressor that can change its capacity is being required in these days.

The rotary compressor has used a refrigerant containing a CFC-based chlorine. However, such a refrigerant is known as a factor causing destruction of the ozone layer, which results in global warming. As a result, its use is legally regulated and extensive researches have been made for an alternative refrigerant with respect to the existing refrigerant. Carbon dioxide is expected as an alternative refrigerant. Moreover, the global warming leads issues of improvement of energy efficiency of a device as well as issues of the alternative of the existing refrigerant.

Naturally, about a compressor considered as the heart of a freezing system, the biggest concern is how alternative refrigerants harmless to global environment can be used in existing compressors without the performance loss.

There is a multi-stage rotary compressor having a plurality of compression units which can change its capacity and use an alternative refrigerant.

FIG. 1 is a sectional view showing one example of the conventional multiple-stage rotary compressor.

As shown, the conventional multiple-stage rotary compressor includes: a casing 1 at which two gas suction pipes 30 and 31 and a gas discharge pipe 40 are installed to communicate with each other; a motor unit 2 installed at an upper side of the casing 1 and including a stator 3 and a rotor 4 for generating a rotary force; and a first compression unit 10 and a second compressor unit 20 installed at upper and lower portions of a lower side of the casing 1 and respectively compressing a refrigerant upon receiving a rotary force generated from the motor unit 2 by a rotary shaft 5.

One accumulator 6 for separating liquefied refrigerant from a suction refrigerant is installed between the gas suction pipes 30 and 31 and between the compression units 10 and 20. The first gas suction pipe 30 supplies a refrigerant to a first cylinder 11 by being connected to a first suction port 17, and the second gas suction pipe 31 supplies a refrigerant to a second cylinder 21 by being connected to a second suction port 27.

The first compression unit 10 includes: a first cylinder 11 formed as a ring shape and installed inside the casing 1; an upper bearing 12 and a middle bearing 13 covering both upper and lower sides of the first cylinder 11, forming a first inner space 19 together, and supporting the rotary shaft 5 in radial and axial directions; a first rolling piston 14 rotatably coupled to an upper eccentric portion of the rotary shaft 5 and orbiting in a first internal space 19 of the first cylinder 11 to thereby compress a refrigerant; a first vane (not shown) coupled to the first cylinder to be movable in a radial direction so as to pressingly contact with an outer circumferential surface of the first rolling piston 14, and dividing the first inner space 19 of the first cylinder 11 into a first suction chamber and a first compression chamber; and a first discharge valve 15 coupled to a front end of a first discharge port 16 provided at the upper bearing 12 to open or close the first discharge port 16, for controlling the discharge of a refrigerant gas.

The second compression unit 20 includes: a second cylinder 21 formed as a ring shape and installed under the first cylinder 11 inside the casing 1; a middle bearing 13 and a lower bearing 22 covering both upper and lower sides of the second cylinder 21, forming a second inner space together, and supporting the rotary shaft 5 in a radial direction and an axial direction; a second rolling piston 23 rotatably coupled to a lower eccentric portion of the rotary shaft 5, and orbiting in the second inner space of the second cylinder 21 to compress a refrigerant; a second vane (not shown) coupled to the second cylinder 21 to be movable in a radial direction so as to pressingly contact with an outer circumferential surface of the second rolling piston 23, and dividing the second inner space 29 into a second suction chamber and a second compression chamber; and a second discharge valve 24 coupled to a front end of a second discharge port 26 provided at the lower bearing 22 to open or close the second discharge port 26, for controlling the discharge of a refrigerant gas discharged from the second compression chamber.

The operation of the conventional multiple-stage rotary compressor having such a structure will now be described.

When the rotor 4 rotates as power is applied to the stator 3 of the motor unit 2, the rotary shaft 5 rotates together with the rotor 4, transferring a rotary force of the motor unit 2 to the first compression unit 10 and the second compression unit 20. Thus, a refrigerant gas is sucked and compressed in the inner spaces 19 and 29 of the compression units 10 and 20 by the rolling pistons 14 and 23 and the vane (not shown). At this time, in the first compression unit 10 and the second compression unit 20, suction, compression and discharge strokes are alternately performed with a phase difference of about 180 degrees.

Such an ordinary multi-stage rotary compressor sequentially performs suction, compression and discharge of a refrigerant as the rolling piston contacts with an inner diameter of the cylinder at one point. In order to generate many loads and thereby obtain a high capacity (hereinafter, referred to as power mode), the compression units are respectively driven. At this time, the capacity of the compressor would be the sum total of refrigerant discharged from each compression unit. In order to obtain power saving effect with a low capacity due to a reduced load (hereinafter, referred to as saving mode), refrigerants sucked into some compression units are cut off, or the vane moves back and is fixed by a piece or the like, thereby removing a boundary between the suction chamber and the compression chamber, so that the rolling piston does not compress refrigerant but is idled.

As another method of implementing the saving mode, the capacity of the refrigerant is changed by speed changes using an inverter motor having a control drive as a driving unit.

The structure of the ordinary rotary compressor and a driving method therefor have the following problems.

First, the method in which the vane is moved back and fixed in the saving mode has problems that a special part such as a piece or the like and a space where the part is mounted are undesirably required, and the number of manufacturing processes increases.

Secondly, as the piece repetitively applies an impact on the vane, a surface of the vane may be damaged as time goes on, and reliability issues such as abrasion, foreign substance generations and the like may be caused.

Thirdly, using an inverter motor as a driving unit may bring about an increase in manufacturing cost since the inverter motor is expensive in general. Accordingly, there is a need to implement capacity changes with a relatively cheap constant speed motor.

Fourthly, when an existing constant speed motor is used, ON/OFF operation is frequently repeated for a room temperature control. For this reason, power consumption is great due to a starting current, and abrasion of a compression unit increasingly occurs, which results in degradation of reliability of a compression unit. Also, since a variation between a set temperature and a room temperature is great in ON/OFF of the constant speed motor, it is difficult to control the room temperature for a delight condition of a room.

Fifthly, when the compression unit is idled or suction of the refrigerant is prevented, some compression units are not used at all, which degrades efficiency of the compressor.

SUMMARY OF THE INVENTION

Therefore, an object of the present invention is to provide a multi-stage rotary compressor capable of maximizing compressing efficiency using all compression units, changing a capacity in operation and reducing the amount of consumed power and abrasion between parts.

To achieve these and other advantages and in accordance with the purpose of the present invention, as embodied and broadly described herein, there is provided an apparatus for changing capacity of a multi-stage compressor comprising: a first cylinder provided with a first suction and a first discharge port, and divided into a first suction chamber and a first compression chamber by a first rolling piston which orbits and a first vane which makes a linear movement in contact with the first rolling piston; a second cylinder provided with a second suction port and a second discharge port, and divided into a second suction chamber and a second compression chamber by a second rolling piston which orbits and a second vane which makes a linear movement in contact with the second rolling piston; a middle bearing inserted between the first cylinder and the second cylinder, having a bypass hole to allow communication between the compression chambers of the first cylinder and the second cylinder, and having a valve hole for communication in the middle of the bypass hole; a sliding valve slidingly coupled to the valve hole of the middle bearing, and selectively opening or closing the bypass hole; and a pressure switching unit for selectively supplying discharge pressure to one side of the sliding valve.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Figure 1:
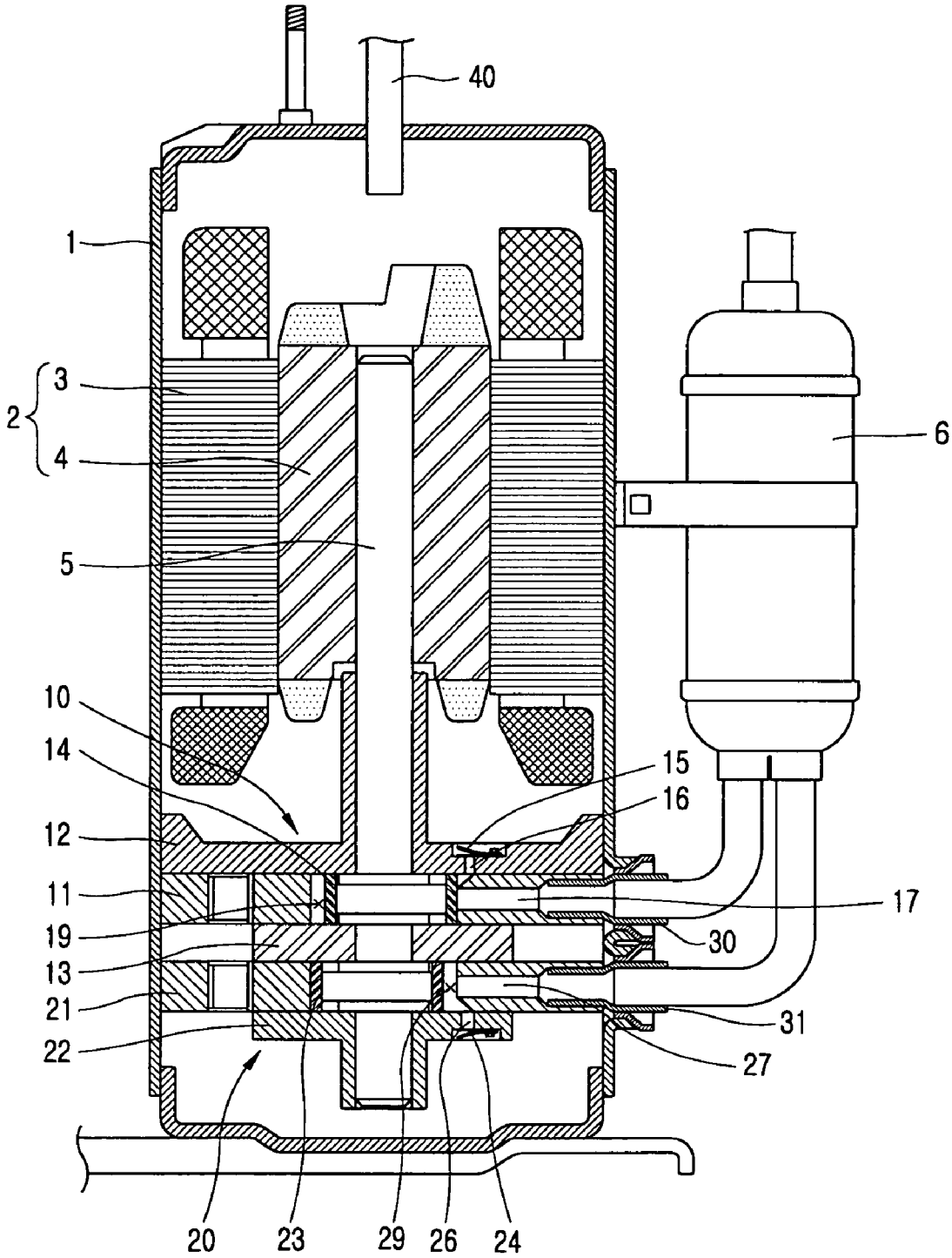
FIG. 1 CONVENTIONAL ART
FIG. 1 is a sectional view showing one example of a conventional multi-stage rotary compressor.

Reference will now be made in detail to the preferred embodiments of the present invention, examples of which are illustrated in the accompanying drawings. The same reference numerals designate the same parts as the conventional art.

Figure 2:
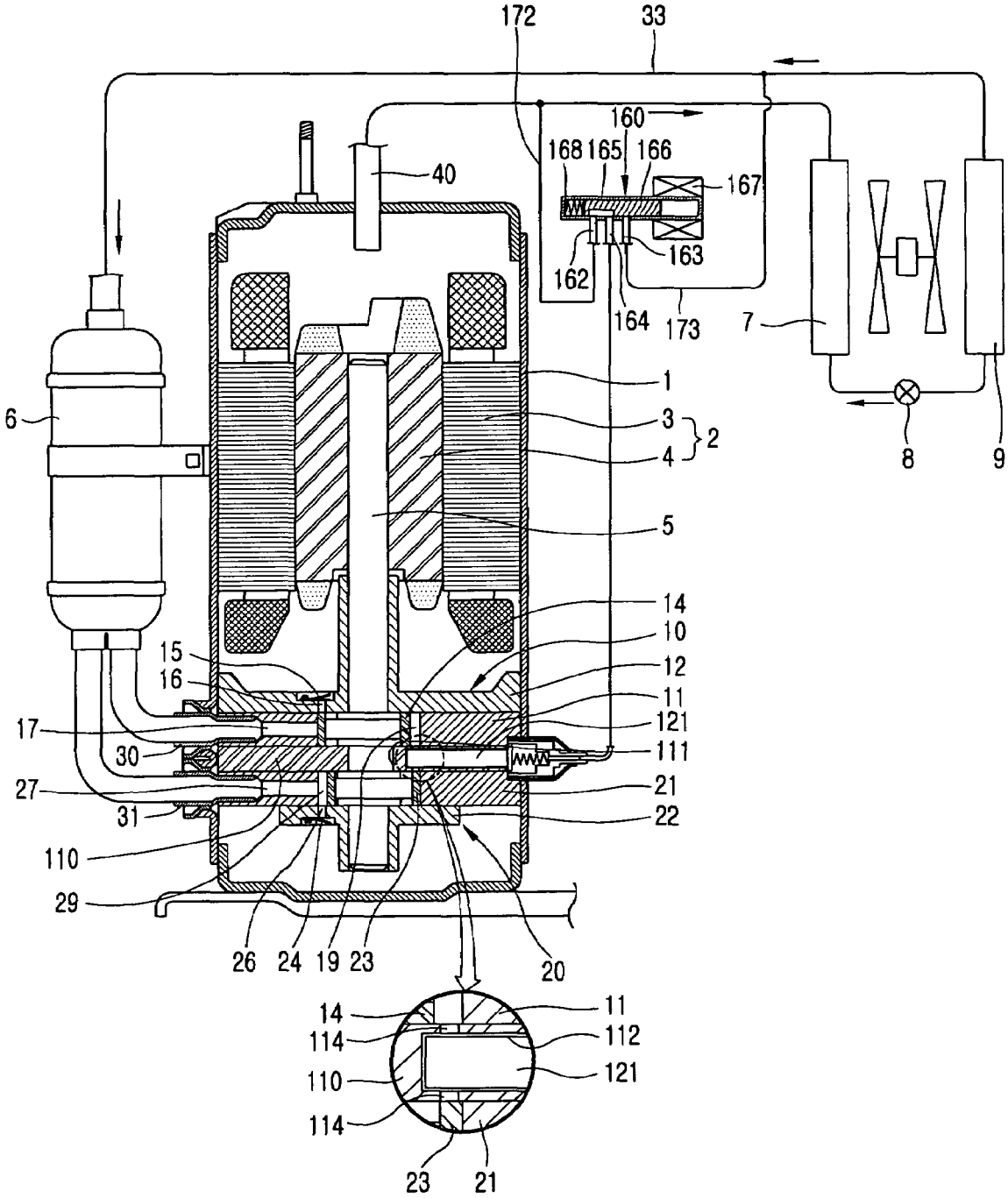
FIG. 2 is a sectional view showing a multi-stage rotary compressor in accordance with a first embodiment of the present invention.

FIG. 2 is a sectional view showing a multi-stage rotary compressor in accordance with a first embodiment of the present invention.

As shown, the multi-stage rotary compressor in accordance with the present invention includes: a casing 1 at which a plurality of gas suction pipes 30 and 31 and a gas discharge pipe 40 are installed to communicate with each other; a motor unit 2 installed at an upper side of the casing and generating a rotary force; a first compression unit 10 and a second compression unit 20 installed at a lower side of the casing 1 in a multi-stage, for respectively compressing refrigerants upon receiving a rotary force, which is generated at the motor unit 2, by the rotary shaft 5; a first sliding valve 121 selectively communicating with the two compression units 10 and 20, for selectively changing a capacity of the compressor; and a first pressure switching unit 160 selectively supplying a high pressure refrigerant gas to the back of the first sliding valve 121, for independently controlling the opening/closing operation of the first sliding valve 121.

The motor unit 2 includes: a stator 3 fixed in the casing 1 and receiving power from the outside; and a rotor 4 disposed inside the stator 3 with a certain air gap therebetween and rotating, interworking with the stator 3.

The first compression unit 10 includes: a first cylinder 11 formed as a ring shape, installed inside the casing 1 and having therein a first suction port 17 through which a refrigerant is sucked; an upper bearing 12 and a middle bearing 110 covering both upper and lower sides of the first cylinder 11, forming a first inner space 19 together, and supporting the rotary shaft 5 in a radial direction and an axial direction; a first rolling piston 14 rotatably coupled to an upper eccentric portion of the rotary shaft 5, orbiting in the first inner space 19 of the first cylinder 11 to thereby compress a refrigerant; a first vane (not shown) movably coupled to the first cylinder 1 in a radial direction so as to pressingly contact with an outer circumferential surface of the first rolling piston 14, and dividing the first inner space 19 into a first suction chamber and a first compression chamber; and a first discharge valve 15 coupled to a front end of a first discharge port 16 provided at a central portion of the upper bearing 12 to open or close the first discharge port 16, and controlling the discharge of a refrigerant gas discharged from the first compression chamber.

Th inner space 19 of the first cylinder 11 may have the same volume as that of an inner space 29 of a second cylinder 21 to be described later. However, the volume of the inner space 19 may be different from that of the inner space 29.

The second compression unit 20 includes: a second cylinder 21 formed as a ring shape, installed under the first cylinder 11 in the casing 1, and having therein a second suction port 27 through which a refrigerant is sucked; a middle bearing 110 and a lower bearing 22 covering both upper and lower sides of the second cylinder 21, forming a second inner space 29 together, and supporting the rotary shaft 5 in a radial direction and an axial direction; a second rolling piston 23 rotatably coupled to a lower eccentric portion of the rotary shaft 5, and orbiting in the second inner space 29 of the second cylinder 21 to thereby compress a refrigerant; a second vane (not shown) movably coupled to the second cylinder in a radial direction so as to pressingly contact with an outer circumferential surface of the second rolling piston 23, and dividing the second inner space 29 into a second suction chamber and a second compression chamber; and a second discharge valve 24 coupled to a front end of the second discharge port 26 provided at a central portion of the lower bearing 22 to open or close the second discharge port 2, and controlling the discharge of a refrigerant gas discharged from the second compression chamber.

At this time, the first vane and second vane are disposed side by side in a horizontal direction, the first suction port 17 and the second suction port 27 are also disposed side by side in a horizontal direction, and the first discharge port 16 and the second discharge port 26 are disposed collinearly in a vertical direction.

The middle bearing 110 is formed as a disc shape having at its center a shaft hole 111 through which the rotary shaft 5 penetrates. A bypass hole 114 is penetratingly formed at the middle bearing 110 in an axial direction, so that the inner spaces 19 and 29 of the first cylinder 11 and the second cylinder 21 communicate with each other. In more detail, the first bypass hole 114 is preferably formed to allow the compression chambers of the first and second inner spaces 19 and 29 to communicate with each other. A first valve hole 112 communicating with the first bypass hole 114 is formed at the middle bearing 110 in a radial direction, so that the first sliding valve 121 is slidingly coupled thereto.

The pressure switching unit 160 is a kind of pilot valve, and includes: a first switching valve housing 165 provided with a high pressure inlet 162, a low pressure inlet 163 and a common outlet 164; a first switching valve 166 slidingly coupled inside the first switching valve housing 165 and selectively connecting the high pressure inlet 162 with the common outlet 164 or the low pressure inlet 163 with the common outlet 164; a first electromagnet 167 installed at one side of the first switching valve housing 165 and moving the first switching valve 166 by applied power; and a first switching spring 168 for restoring the first switching valve 166 when the power applied to the first electromagnet 167 is cut off.

As for the first pressure switching unit 160, the high pressure inlet 162 is connected to the gas discharge pipe 40 by a first high pressure connection pipe so that high pressure formed in the casing 1 is supplied to the high pressure inlet 162, and, by a first low pressure connection pipe 173, the low pressure inlet 163 is connected to the middle of a connection pipe 33 through which a refrigerant is sucked to an accumulator 6 for separating gas-liquid from refrigerants, so that low pressure is supplied to the low pressure inlet 163. And a first common connection pipe 174 connects the common outlet 164 to a back side of the first sliding valve 121 so that a high pressure atmosphere or a low pressure atmosphere is supplied to the back side.

Figure 3:
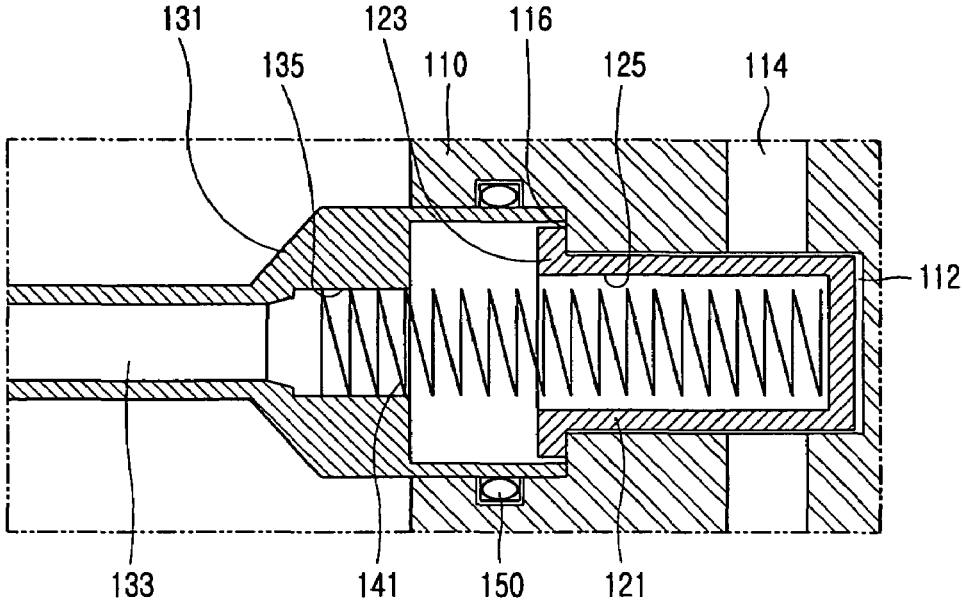
FIG. 3 is a sectional view showing the closing of a bypass hole in accordance with the first embodiment of the present invention.
Figure 4:
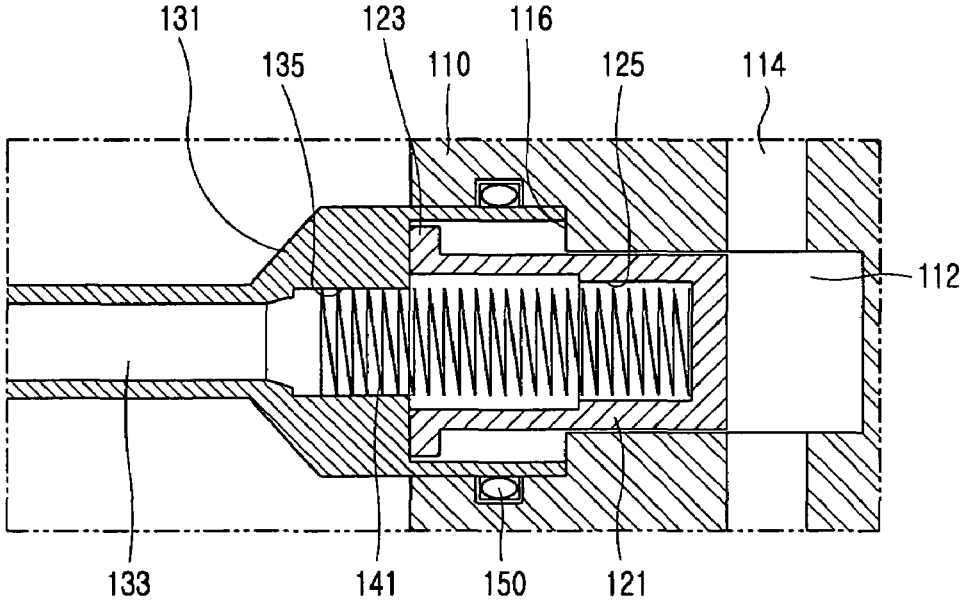
FIG. 4 is a sectional view showing the opening of the bypass hole in accordance with the first embodiment of the present invention.

FIGS. 3 and 4 are sectional views partially showing an apparatus for changing a capacity of the multi-stage rotary compressor in accordance with the present invention.

As shown, a valve stopping projection 116 is stepped at an inner side of an inner circumferential surface of the first valve hole 112 in order to restrict a movement of the first sliding valve 121 by stopping a stopping protrusion 123 formed at the first sliding valve 121 in the closing of the first sliding valve 121. A valve stopper 131 is insertedly coupled into the valve hole 112 from the outside in order to restrict a movement of the first sliding valve 121 by stopping the stopping projection 123 when the first sliding valve 121 opens the first bypass hole 114.

The valve stopper 131 has a communication hole 133 connected to the common connection pipe 174 of the first pressure switching unit 160 so that high pressure or low pressure refrigerant gas can be supplied to the back of the first sliding valve 121. A spring fixing step 135 with a screw thread (not shown) is formed at an inner circumferential surface of the communication hole 133 so that a valve spring 141 to be described later is screw-threaded thereto.

The first sliding valve is formed as a cylindrical body whose inner diameter side (hereinafter, referred to as a front end) is closed. At an outer circumferential surface of the other end of the first sliding valve 121 (hereinafter, referred to as a rear end), the stopping protrusion 123 is protrudingly formed to restrict a moving distance of the first sliding valve 121 by being caught by the valve stopping projection 116. Also, a spring fixing step 125 with a screw thread (not shown) for fixing the valve spring 141 by means of screw-threading is stepped at an inner circumferential surface of the front end of the first sliding valve 121.

The valve spring 141 may be substituted by another elastic member.

As shown in FIG. 4, a valve spring 141 is installed inside the first sliding valve. Here, the valve spring is an extended spring that is compressed when pressure applied to its one side through the communication hole 133 and pressure applied to its other side through the first bypass hole 114 are balanced, so that the first sliding valve 121 is pulled toward the valve stopper 131 to open the first bypass hole 114. In contrast, as shown in FIG. 3, when the pressure applied to one side of the first sliding valve 121 through the communication hole 133 is greater than the pressure applied to its other side through the first bypass hole 114, the valve spring 141 is extended so that the first sliding valve 121 closes the first bypass hole 114.

In FIG. 2, unexplained reference numeral 7 is a condenser, 8 is an expansion apparatus, 9 is an evaporator, and 150 is an O-ring.

The apparatus for changing a capacity of the rotary compressor in accordance with the present invention is operated as follows.

Namely, when power is applied to a motor unit 2, the rotary shaft 5 rotates, and a rotary force is transmitted to the first compression unit 10 and the second compression unit 20. Thus, the first rolling piston 14 and the second rolling piston 23 orbit in pressure-contact with inner circumferential surfaces of the inner spaces 19 and 29 of the cylinders 11 and 21, respectively. At this time, each of first and second vanes (not shown) divides the inner space 19 and 29 into a suction chamber and a compression chamber. Refrigerants are sucked through the suction ports 17 and 27 formed at the suction chambers, are compressed by a volume change in the compression chambers, and are discharged into the casing 1 through the discharge ports 16 and 26. The discharge refrigerants are spurted to a condenser 7 of a freezing cycle through the gas discharge pipe 40, and pass through the expansion apparatus 8 and the evaporator 9 in order, and then are sucked again into the internal space 19 and 29 of each cylinder 11 and 21 through the gas suction pipes 30 and 31. And such processes are repeated.

Here, the multi-stage rotary compressor operates, changing its capacity according to an operational state of an air conditioner using the same. A power mode and a saving mode will now be explained, respectively.

First, the multi-stage rotary compressor operates in a power mode when the first compression unit 10 and the second compression unit 20 operate, separately. Namely, as shown in FIG. 3, an electromagnet 167 of the first pressure switching unit 160, a pilot valve, is turned on, so that the first switching valve 166 overcomes the switching spring 168 and allows communication between the high pressure inlet 162 and the common outlet 164. Here, the high pressure inlet 162 is connected to the first high pressure connection pipe 172, and the first high pressure connection pipe 172 is connected to the gas discharge pipe 40. For this reason, the discharge pressure is applied to one side of the first sliding valve 121 through the first common connection pipe 174 and the communication hole 133. At this time, the inner pressure of each cylinder 11 and 21 is applied to the other side of the first sliding valve 121 through the first bypass hole 114, and the inner pressure is smaller than the discharge pressure. Therefore, the valve spring 140 is extended, moving the first sliding valve 121 forward so as to block the first bypass hole 114. Thus, a refrigerant gas sucked to the first cylinder 11 and a refrigerant gas sucked to the second cylinder 21 are not mixed together but are compressed and discharged into the casing 1, respectively.

Then, it will now be described that the multi-stage rotary compressor operates in a saving mode. As shown in FIG. 4, the electromagnet 167 of the first pressure switching unit 160 is turned off to allow communication between the low pressure inlet 163 and the common outlet 164. The low pressure inlet 163 is connected to the first low pressure connection pipe 173 and the connection pipe 33 so that a low pressure refrigerant flow therein. Such a refrigerant is supplied to a back surface of the first sliding valve 121 through the communication hole 13. When it comes to such a state, the first sliding valve 121 moves backward by a compression force of the valve spring 141 to thereby open the first bypass hole 114. By the opening of the first bypass hole 114, the compression chambers (not shown) of the internal spaces 19 of the cylinders 11 and 21 communicate with each other. The first rolling piston 14 and the second rolling piston 23 have been disposed with a phase difference of 180 degrees, and a volume and internal pressure of the first compression chamber where the first bypass hole 114 is exposed, of the inner space 19 of the first compression unit 10, are different from those of the second compression chamber where the first bypass hole 114 is exposed, of the inner space 29 of the second compression unit 20. Namely, if the pressure of the first compression chamber is greater than that of the second compression chamber, the refrigerants move to the second compression chamber from the first compression chamber through the first bypass hole 114 and thus cannot be compressed.

From a position where the first bypass hole 114 is closed by the first rolling piston 14 or the upper eccentric portion because of continuous rotation, refrigerants are no longer bypassed, but are compressed in the first compression chamber and discharged through the first discharge port 16. Namely, because some refrigerants are bypassed and some are compressed and discharged, the amount of the discharged refrigerants are reduced.

In the same manner, if the pressure of the second compression chamber is greater than that of the first compression chamber, the refrigerants move from the second compression chamber to the first compression chamber through the first bypass hole 114, and thus cannot be compressed. Then, from a position where the second rolling piston 23 or the eccentric portion closes the first bypass hole 114, the refrigerants are no longer bypassed but are compressed and then discharged.

When each compression unit 10 and 20 operates in the saving mode, the refrigerants are not compressed as much as an entire volume of each compression chamber, and some are bypassed from a high pressure compression chamber to a low pressure compression chamber. Only some of the refrigerants are compressed and discharged. Such processes are repeated, thereby decreasing a discharge capacity of the refrigerants. In such a manner, the change of the capacity in the power mode or in the saving mode can be achieved.

Hereinafter, a second embodiment of the present invention will be described. In the second embodiment, a bypass hole is formed in plurality so that multi-stage capacity changes can be achieved.

Figure 5:
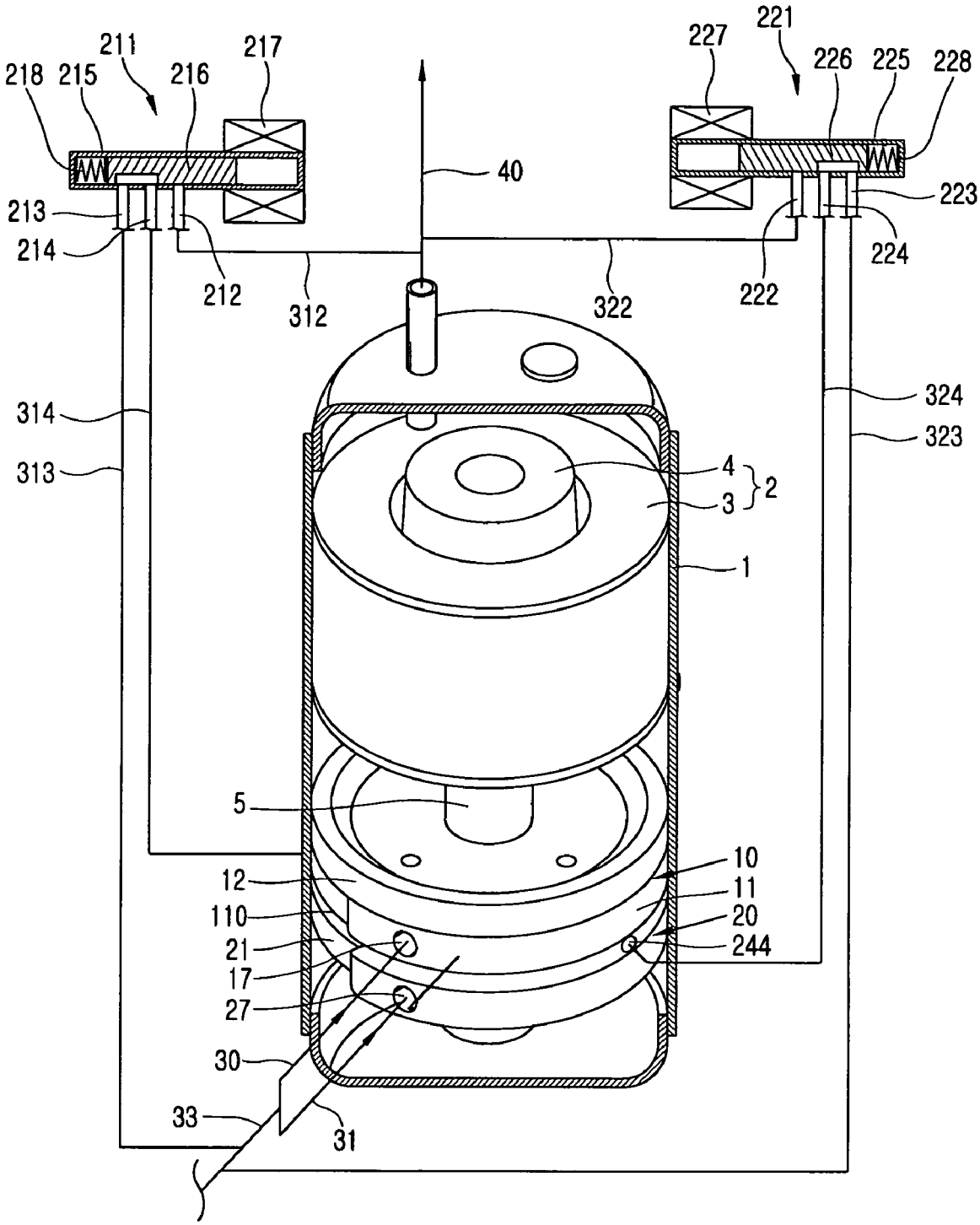
FIG. 5 is a block diagram for showing capacity changes in accordance with a second embodiment of the present invention.
Figure 6:
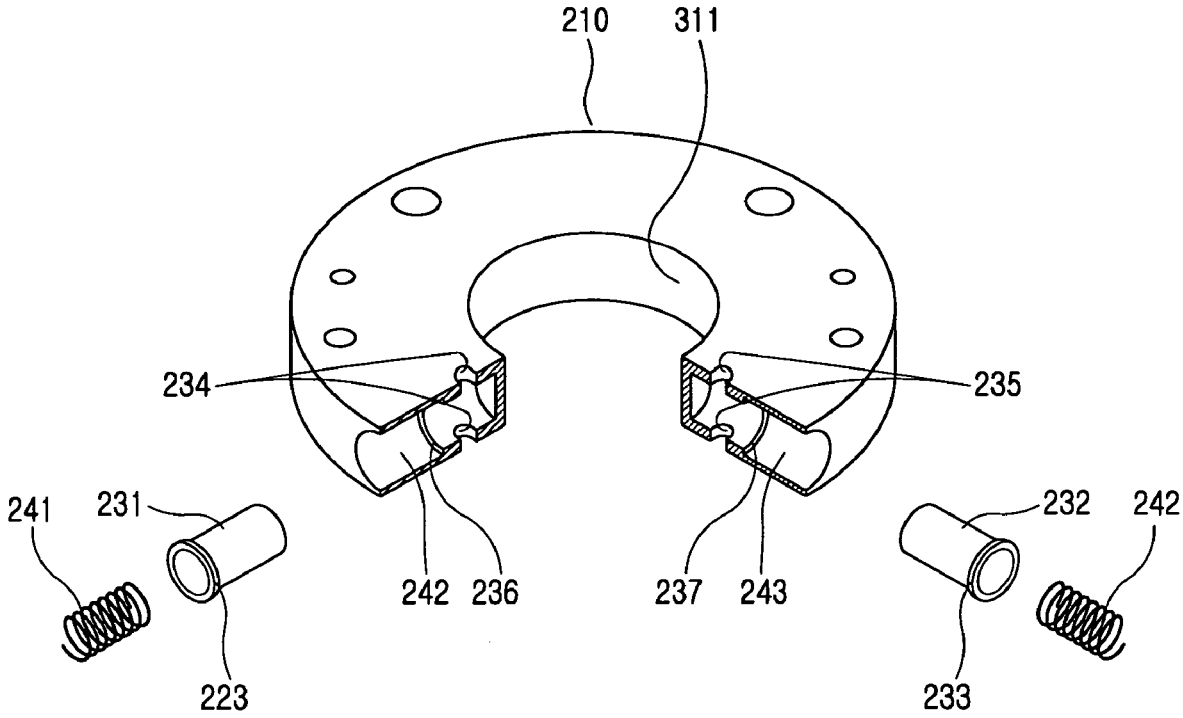
FIG. 6 is a partially exploded perspective view showing a main part in accordance with the second embodiment of the present invention.

FIG. 5 is a partially cut-out view showing a multi-stage rotary compressor in accordance with the second embodiment of the present invention, and FIG. 6 is an exploded perspective view showing a middle bearing in accordance with the second embodiment of the present invention. Like reference numerals designate like or corresponding parts to the first embodiment.

As shown, the middle bearing 210 is formed as a disc shape having at its center a shaft hole 311 through which a rotary shaft 5 penetrates, and a second bypass hole 234 and a third bypass hole 235 are penetratingly formed at one side of a vane in an axial direction.

The second bypass hole 234 and the third bypass hole 235 are formed in turn along a rotating direction of the rotary shaft on the basis of the vane. For example, the second bypass hole 234 is formed in the vicinity of 160 degrees from the first vane along a rotating direction of the rotary shaft, and the third bypass hole may be formed in the vicinity of 240 degrees.

Also, a second valve hole 243 and a third valve hole 244 having predetermined depths are formed to communicate with the second bypass hole 234 and the third bypass hole 235 in a radial direction, and a second sliding valve 231 and a third sliding valve 232 are slidingly coupled thereto, respectively.

The second pressure switching unit 211 is a kind of pilot valve, and includes a second switching valve housing 215 at which a high pressure inlet 212, a low pressure inlet 213 and a common outlet 214 are formed; a second switching valve 216 slidingly coupled inside the second switching valve housing 215, for selectively connecting the high pressure inlet 212 with the common outlet 214 or the low pressure inlet 213 with the common outlet 214; a second electromagnet 217 installed at one side of the second switching valve housing 215, for moving the second switching valve 216 by applied power; and a second switching spring 218 for restoring the second switching valve 216 when the power applied to the second electromagnet 217 is cut off.

In the second pressure switching unit 211, the high pressure inlet 212 is connected to the gas discharge pipe 40 by a second high pressure connection pipe 312 so that high pressure formed in the casing 1 can be supplied to the high pressure inlet 212, and by a second low pressure connection pipe 313, the low pressure inlet 213 is connected to the middle of a connection pipe 33 connected to each refrigerant suction pipe 30 and 31 so that low pressure is supplied to the low pressure inlet 213. Also, the common outlet 213 is connected to a back side of a second sliding valve 231 by a second common connection pipe 314 so that an high pressure or low pressure atmosphere is supplied to the back side.

The third rear pressure switching unit 221 is a kind of pilot valve, and includes a third switching valve housing 225 at which a high pressure inlet 222, a low pressure inlet 223 and a common outlet 224 are formed; a third switching valve 226 slidingly coupled inside the third switching valve housing 225, for selectively connecting the high pressure inlet 222 or the low pressure inlet 223 to the common outlet 224; a third electromagnet 227 installed at one side of the third switching valve housing 225, for moving the third switching valve 226 by applied power; and a third switching spring 228 for restoring the third switching valve 226 when power applied to the third electromagnet 227 is cut off.

In the third pressure switching unit 221, the high pressure inlet 222 is connected to the gas discharge pipe 40 by a third high pressure connection pipe 322 so that high pressure formed in a casing 1 is supplied to the high pressure inlet 222, and by a third low pressure connection pipe 323, the low pressure inlet 223 is connected to the middle of the connection pipe 33 connected to each refrigerant suction pipe 30 and 31 so that low pressure is supplied to the low pressure inlet 223. Also, the common outlet 224 is connected to a rear side of a third sliding valve 232 by a third common connection pipe 324 so that a high pressure or low pressure atmosphere is supplied to the back side.

As shown in FIG. 6, a valve stopping projection 236 is stepped at the inside of an inner circumferential surface of the second valve hole 243 in order to restrict a movement of the second sliding valve 231 by stopping a stopping protrusion 223 of the second sliding valve 231 in the closing of the second sliding valve 231. And, a valve stopper (not shown) is insertedly coupled to the valve hole 243 from the outside in order to restrict a movement of the second sliding valve 231 by stopping the stopping protrusion 223 in the opening of the second sliding valve 231.

Also, in the same manner, a valve stopping projection 237 is stepped at the inside of an inner circumferential surface of the third valve hole 244 in order to restrict a movement of the third sliding valve 232 by stopping a stopping protrusion 233 of the third sliding valve 232 in the closing of the third sliding valve 232. And, a valve stopper (not shown) is insertedly coupled to the valve hole 244 from the outside in order to restrict a movement of the third sliding valve 232 by stopping the stopping protrusion 233 in the opening of the third sliding valve 232.

A structure of the valve stopper is the same as that of the first embodiment. Also, as in the first embodiment, a spring fixing step (not shown) provided with a screw thread for fixing the valve springs 241 and 242 by means of screw-threading is stepped at an inner circumferential surface of the front end of each of the second and third sliding valves 231 and 232.

The operation and the effect of the second embodiment of the present invention will now be described.

Figure 7:
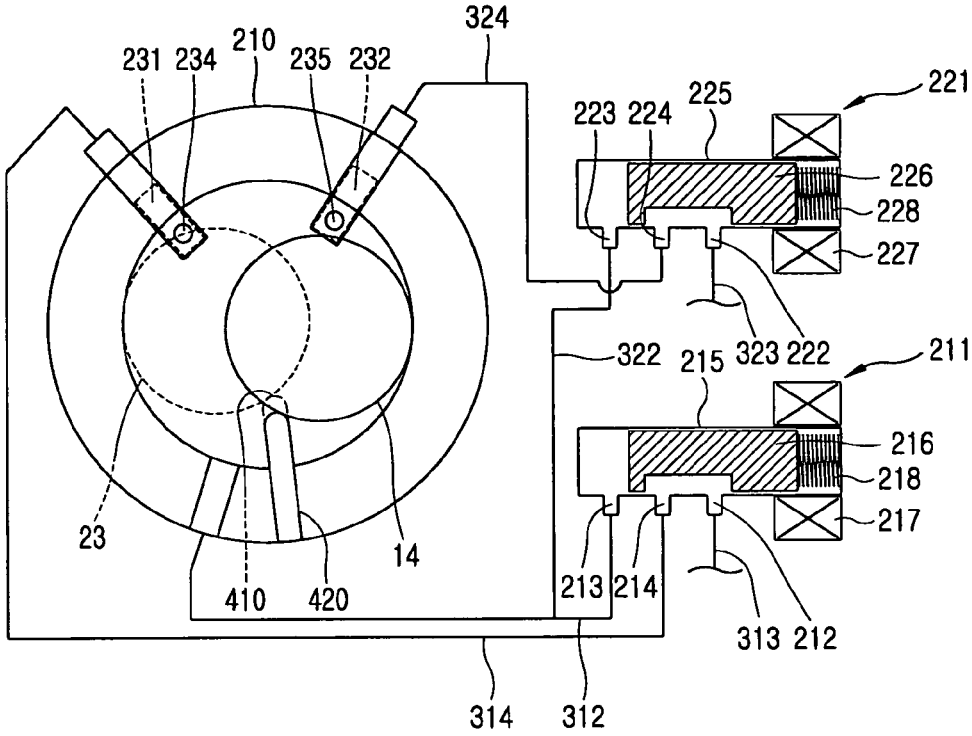
FIGS. 7, 8 and 9 are sectional views showing the operation according to the second embodiment of the present invention.
Figure 8:
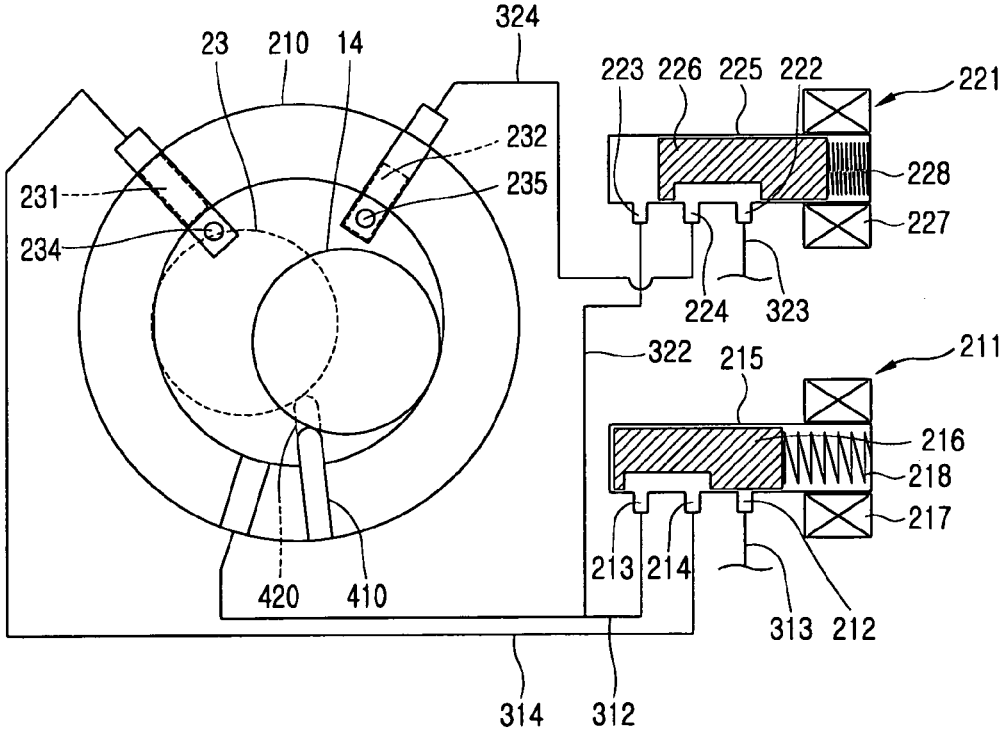
Figure 9:
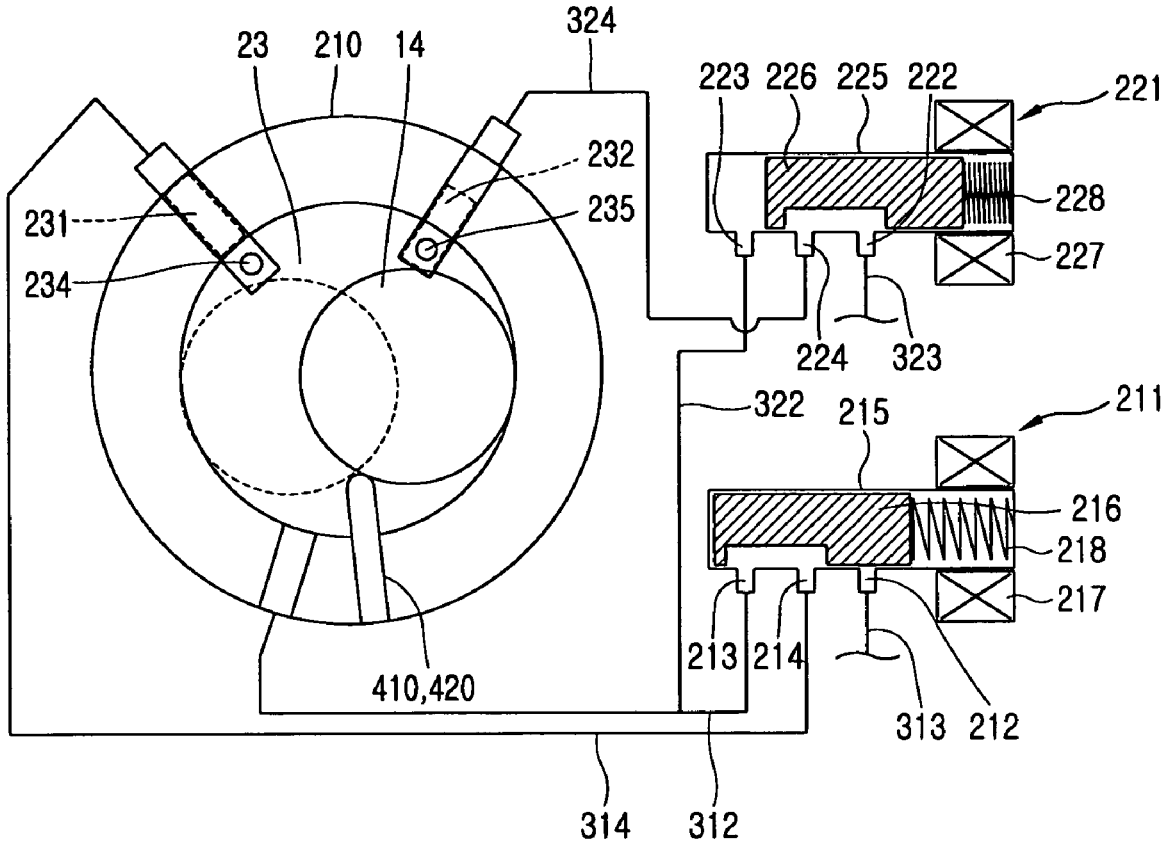

FIGS. 7, 8 and 9 are sectional views for explaining the operation in accordance with the second embodiment of the present invention.

First, a power mode will be described. In the power mode, the compression units 10 and 20 operate, separately, to thereby discharge 100% of refrigerant flux. As shown in FIG. 7, when the electromagnet 217 of the second pressure switching unit 211, a pilot valve, is turned on, the second switching valve 216 overcomes the switching spring 218 to allow communication between the high pressure inlet 212 and the common outlet 214. When it comes to such a state, discharge pressure applied to one side of the second sliding valve 231 gets higher than the internal pressure applied to the other side of the second sliding valve 231, of each cylinder 11 and 21, thereby moving forward the second sliding valve 231 and blocking the second bypass hole 234. Likewise, when the electromagnet 227 of the third pressure switching unit 221 is turned on to thereby allow communication between the high pressure inlet 222 and the common outlet 224, the third sliding valve 232 moves forward to block the third bypass hole 235. Thus, the refrigerant gas sucked to the first cylinder 11 and the refrigerant gas sucked to the second cylinder 21 are not mixed but completely compressed and discharged into the casing 1, alternately.

Next, it will be explained that a multi-stage rotary compressor operates in a saving mode. As shown in FIG. 8, when the electromagnet 217 of the second pressure switching unit 211 is turned on, the second switching valve 216 overcomes the switching spring 218 to allow communication between the high pressure inlet 212 and the common outlet 214. When it comes to such a state, the discharge pressure applied to one side of the second sliding valve 231 gets higher than the internal pressure of each cylinder 11 and 21, which is applied to the other side of the second sliding valve 231, thereby moving forward the second sliding valve 231 and blocking the second bypass hole 234. In contrast, by turning off the electromagnet 227 of the third pressure switching unit 221, the low pressure inlet 223 communicates with the common outlet 224. Since the low pressure inlet 233 is connected to the third low pressure connection pipe and the connection pipe, low pressure refrigerants are flowing therein. Such refrigerants are supplied to the back of the third sliding valve 232 through the communication hole. When it comes to such a state, the third sliding valve 232 moves backward by the compression force of the valve spring, thereby opening the third bypass hole 235 and allowing communication between compression chambers of inner spaces of the cylinders. Namely, as in the saving mode of the first embodiment, the refrigerant is moved from the high pressure compression chamber to the low one through the third bypass hole 235 such that the refrigerant cannot be compressed. Then, from a position where a rolling piston or an eccentric portion closes the third bypass hole 235, the refrigerants are no longer bypassed but are compressed and discharged. In the saving mode, the refrigerants cannot be compressed as much as an entire volume of each compression chamber and are bypassed from the high pressure compression chamber to the low pressure compression chamber. Thus, only some of the refrigerants are compressed and discharged. Such processes are repeated, thereby decreasing a discharge capacity of a refrigerant.

Next, in order to implement another discharge capacity in the saving mode, as shown in FIG. 9, the second bypass hole 234 is opened and the third bypass hole 235 is closed by manipulating the second and third pressure switching unit 211 and 221. The second bypass hole 234 is more adjacent to the vane 410, 420 than the third bypass hole 235 along a rotating direction of the rotary shaft 14 (e.g., the second bypass hole 160 degrees, third bypass hole 240 degrees). Accordingly, the amount of refrigerants compressed and discharged as the rolling piston or the eccentric portion closes the second bypass hole 234 is greater than that of refrigerants discharged as the third bypass hole 235 is closed. Accordingly, the amount of discharged refrigerants can be changed even in the saving mode.

Needless to say, in the same manner, multi-stage capacity changes can be implemented by forming three or more bypass holes at a middle bearing.

As so far described, the multi-stage rotary compressor in accordance with the present invention has the following effect.

First, unlike a method in which a vane is moved back and fixed, the present invention is advantageous in that a special part and a mounting space are not necessary and a manufacturing process is simple. Also, because a piece for the moving back and fixing of the vane is not needed, problems such as abrasion, foreign substance generation and the like are not generated, thereby improving reliability.

Secondly, since a plurality of compression units are all used even in the saving mode, efficiency of a motor and a compressor is improved and power saving effect can also be achieved.

Thirdly, since a capacity is changed using a cheap constant speed motor, a manufacturing cost can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for changing capacity of a multi-stage compressor, comprising:

a first cylinder provided with a first suction port and a first discharge port, wherein the first cylinder has a first inner space formed therein that is divided into a first suction chamber and a first compression chamber by a first rolling piston that orbits therein and a first vane that moves linearly so as to maintain contact with the first rolling piston;

a second cylinder provided with a second suction port and a second discharge port, wherein the second cylinder has a second inner space formed therein that is divided into a second suction chamber and a second compression chamber by a second rolling piston that orbits therein and a second vane that moves linearly so as to maintain contact with the second rolling piston;

a middle bearing positioned between the first cylinder and the second cylinder, the middle bearing having a valve hole formed therein and a bypass hole that intersects the valve hole so as to allow communication between the first and second compression chambers;

a sliding valve slidably coupled to the valve hole so as to selectively open or close the bypass hole, wherein the sliding valve comprises a hollow cylindrical body having a closed end and an open end;

a pressure switching unit that selectively supplies discharge pressure to one end of the sliding valve;

a valve stopper provided at an outer end portion of the valve hole, wherein the valve stopper contacts the open end of the sliding valve so as to restrict movement of the sliding valve during an opening operation;

an elastic member interposed between the sliding valve and the valve stopper;

a stopping protrusion that extends outward from the open end of the sliding valve; and a valve stopping projection formed at an inner circumferential surface of the valve hole, wherein the valve stopping projection contacts the stopping protrusion so as to restrict movement of the sliding valve during a closing operation of the sliding valve, wherein the elastic member is fixed at spring fixing steps respectively formed on inner circumferential surfaces of the sliding valve and the valve stopper, and wherein the elastic member draws the sliding valve toward the valve stopper when pressure at a cylinder side of the sliding valve and a back pressure are balanced so as to open the bypass hole, wherein the elastic member is positioned outside of the flow path of the bypass hole so as to allow refrigerant to flow without resistance.

2. The apparatus of claim 1, wherein a volume of the first inner space of the first cylinder is different from a volume of the second inner space of the second cylinder.

3. The apparatus of claim 1, wherein the first suction port and the second suction port are disposed side by side in a horizontal direction, the first discharge port and the second discharge port are disposed colinearly in a vertical direction, and the first vane and the second vane are disposed side by side in a horizontal direction.

4. The apparatus of claim 1, wherein the bypass hole comprises a plurality of holes.

5. The apparatus of claim 1, wherein the pressure switching unit is formed in plurality.

6. The apparatus of claim 1, wherein the pressure switching unit is a pilot valve.

7. The apparatus of claim 1, wherein a phase difference between the first rolling piston and the second rolling piston is 180 degrees.

8. The apparatus of claim 1, wherein the spring fixing steps are formed in a screw thread shape.

9. The apparatus of claim 1, wherein the pressure switching unit comprises:

a first switching valve housing including a high pressure inlet, a low pressure inlet and a common outlet;

a switching valve slidably coupled inside the switching valve housing so as to selectively connect the high pressure inlet or the low pressure inlet to the common outlet;

an electromagnet installed at one side of the switching valve housing, wherein the electromagnet moves the switching valve using power applied thereto; and a switching spring that restores the switching valve when the power applied to the electromagnet is cut off.

10. The apparatus of claim 9, wherein the pressure switching unit is connected to a high pressure connection pipe connected to a gas discharge pipe to supply high pressure to the high pressure inlet to a low pressure connection pipe connected to a suction pipe to supply low pressure to the low pressure inlet and to a common connection pipe connecting the common outlet to the back side of the sliding valve to supply the high pressure or the low pressure thereto.

11. The apparatus of claim 10, wherein the low pressure connection pipe connects the low pressure inlet to a middle portion of the suction pipe through which a refrigerant is drawn, which is connected to an accumulator that separates gas and liquid in the refrigerant.

* * * * *